US005189997A

United States Patent [19]

Schneider

[11] Patent Number: 5,189,997

[45] Date of Patent: Mar. 2, 1993

[54] INTERNAL-COMBUSTION ENGINE COMPRISING A ROCKER LEVER VALVE GEAR

[75] Inventor: Klaus Schneider, Tiefenbronn-Mühlhausen, Fed. Rep. of Germany

[73] Assignee: Dr. Ing. h.c.F. Porsche AG, Fed. Rep. of Germany

[21] Appl. No.: 906,874

[22] Filed: Jul. 2, 1992

[30] Foreign Application Priority Data

Jul. 4, 1991 [DE] Fed. Rep. of Germany ..... 4122142

[51] Int. Cl.[5] ..... F01L 1/34; F01L 1/12; F01L 1/24

[52] U.S. Cl. ..... 123/90.16; 123/90.39

[58] Field of Search ..... 123/90.15, 90.16, 90.39

[56] References Cited

U.S. PATENT DOCUMENTS

| | | | |
|---|---|---|---|
| 4,459,946 | 7/1984 | Burandt | 123/90.16 |
| 4,655,176 | 4/1987 | Sheehan | 123/90.16 |
| 4,986,227 | 1/1991 | Dewey, III | 123/90.16 |
| 5,018,487 | 5/1991 | Shinkai | 123/90.16 |
| 5,025,761 | 6/1991 | Chen | 123/90.16 |

FOREIGN PATENT DOCUMENTS

| | | | |
|---|---|---|---|
| 91714 | 7/1980 | Japan | 123/90.16 |
| 151108 | 11/1980 | Japan | 123/90.16 |
| 90905 | 5/1985 | Japan | 123/90.16 |

OTHER PUBLICATIONS

SAE Technical Paper Series-Variable Valve Action (VVA) Through Variable Ratio Rocker Arms, Feb. 29-Mar. 4, 1988.

*Primary Examiner*—E. Rollins Cross
*Assistant Examiner*—Weilun Lo
*Attorney, Agent, or Firm*—Evenson, Wands, Edwards, Lenahan & McKeown

[57] ABSTRACT

An internal-combustion engine has a rocker lever valve gear equipped with a roller for the cam-controlled actuating of charge cycle valves. Each rocker lever of the rocker lever valve gear has an arm provided with a circular-arc-shaped longitudinal part. Along the longitudinal part, an abutment point can be shifted as a function of parameters of the internal-combustion engine. The resulting changed leverages on the rocker lever vary the valve lift.

8 Claims, 3 Drawing Sheets

INTERNAL-COMBUSTION ENGINE COMPRISING A ROCKER LEVER VALVE GEAR

BACKGROUND AND SUMMARY OF THE INVENTION

The present invention relates to an internal-combustion engine comprising a rocker lever valve gear which, in a cylinder head, and actuated by a camshaft by an end of a rocker lever, controls at least one charge cycle valve, with the abutment point of the rocker lever being changeable by the swivelling of a shaft.

The SAE Paper 88 07 30 "Variable Valve Action Through Variable Ratio Rocker Arms", 1988, shows an internal-combustion engine which comprises a rocker lever valve gear with a variable valve lift, in which a lower camshaft, by way of a push rod, actuates a rocker lever which acts upon a charge cycle valve by one of its ends. The rocker lever has an internally toothed guiding connecting link in which a correspondingly toothed shaft rolls off. The engaging teeth represent the abutment point of the rocker lever. By rotation of the shaft, this shaft rolls off inside the connecting link of the stationary rocker lever so that the abutment point can be changed. As a result, the leverages at the rocker lever change in such a manner that, when the cam lift is constant, a variable valve lift is created as a function of the position of the abutment point.

Disadvantages of the above-described solution are the high-expenditure toothing, particularly in the rocker levers, as well as the superimposed rotatory and translational movement of the shaft.

An object of the present invention is to provide, while the cam lift is constant, a variable valve lift in an internal-combustion engine comprising a rocker lever valve gear.

This and other objects are achieved by the present invention which provides an internal-combustion engine which includes at least one charge cycle valve and a rocker lever valve gear in a cylinder head and which is actuated by a camshaft. The rocker lever valve gear has a rocker lever with an end that controls the at least one charge cycle valve. The rocker lever also has a changeable abutment point and an arc shaped longitudinal part. A pivotable control shaft and abutment receiving devices are coupled to the control shaft so as to be pivotable together with the control shaft. The longitudinal part of the rocker lever is in contact with the abutment receiving devices at the abutment point. The abutment point of the rocker lever is changed by pivoting the control shaft.

The rocker lever of the present invention has a circular-arc-shaped longitudinal part, along which the abutment point can be shifted. This shifting takes place by a joint swivelling of abutment receiving devices arranged on a shaft. Advantageously, a shifting of the abutment point is achieved by a simple rotation of the shaft. As a function of the curvature of the longitudinal part or of the angle of rotation of the shaft, as a result, the valve lift can be varied without any complicated design of components.

Geometrically simple conditions exist which are favorable with respect to the flux of forces if the radius of curvature of the longitudinal part extends from the longitudinal center axis of the shaft to the longitudinal part, as in an embodiment of the present invention. In a further embodiment, the abutments are hydraulic valve clearance compensating elements which are arranged in the abutment receiving devices.

For a compact construction of modern internal-combustion engines, an embodiment of the present invention provides that the cams of the camshaft are applied at a point of the rocker lever which is situated between the fixed bearing on the upper end of the charge cycle valve and the movable abutment point.

In an embodiment of the present invention, the guiding of the rocker lever on the charge cycle valve takes place rotatably on a shaft which is disposed in parallel to the camshaft and is fastened to the charge cycle valve. On the opposite free end, a guiding takes place in a sliding manner between parallel contact surfaces. The variation of the valve lift takes place as a function of parameters of the internal-combustion engine, such as load and rotational speed, by a control element which is applied to a pivoted lever which is non-rotatably arranged on the shaft. This control element may, for example, comprise pistons which are acted upon hydraulically and are applied to the pivoted lever. In this case, the oil pressure can be utilized which already exists in the cylinder head. As an alternative, the control element may comprise an electric motor or magnet or a pneumatic cylinder which rotates the shaft continuously as a function of, for example, the intake pipe vacuum.

Other objects, advantages and novel features of the present invention will become apparent from the following detailed description of the invention when considered in conjunction with the accompanying drawings.

DETAILED DESCRIPTION OF THE DRAWINGS

Figure 1:
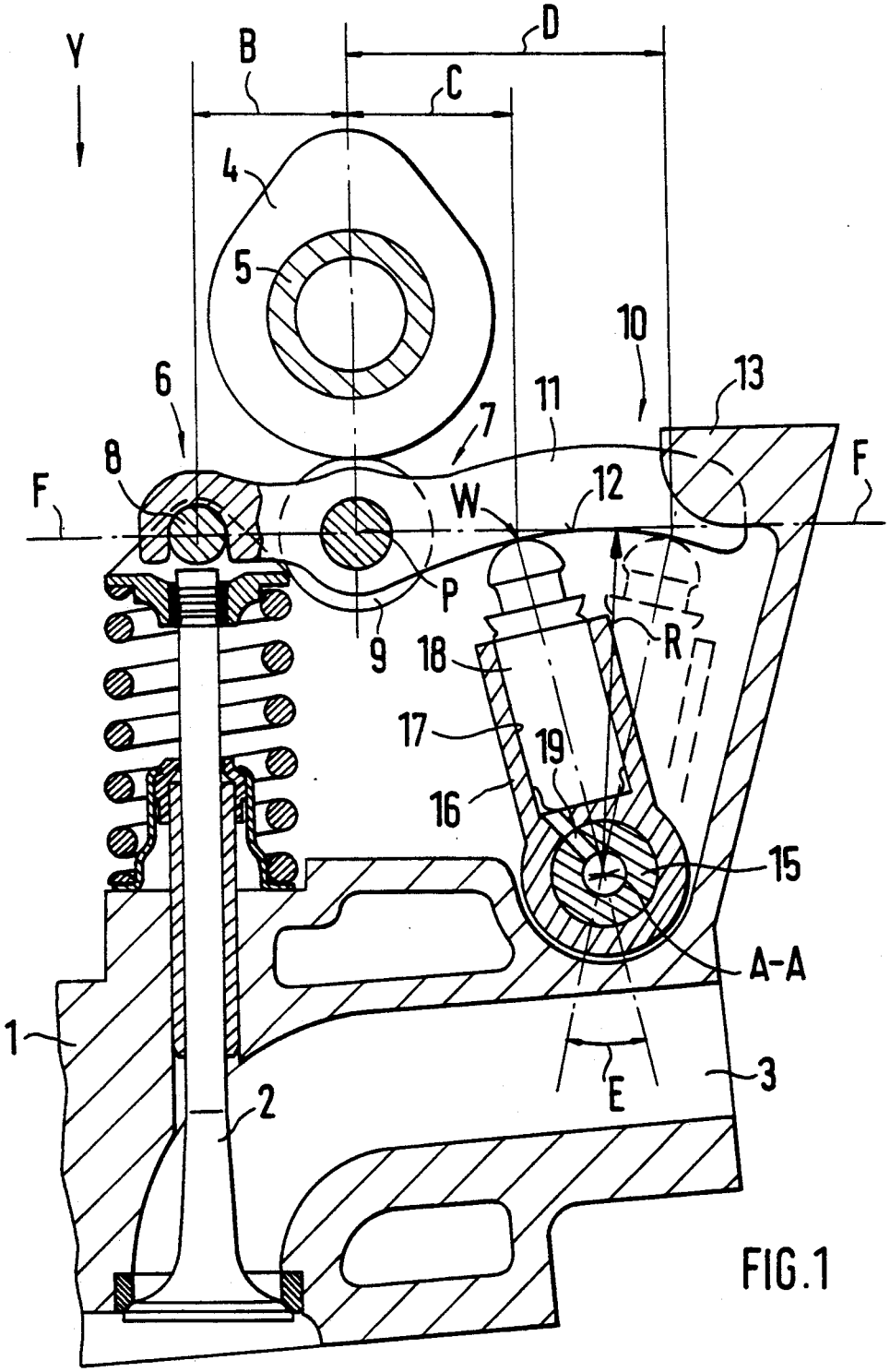
FIG. 1 is a sectional view of a rocker lever valve gear constructed in accordance with an embodiment of the present invention in a cylinder head of an internal-combustion engine.
Figure 2:
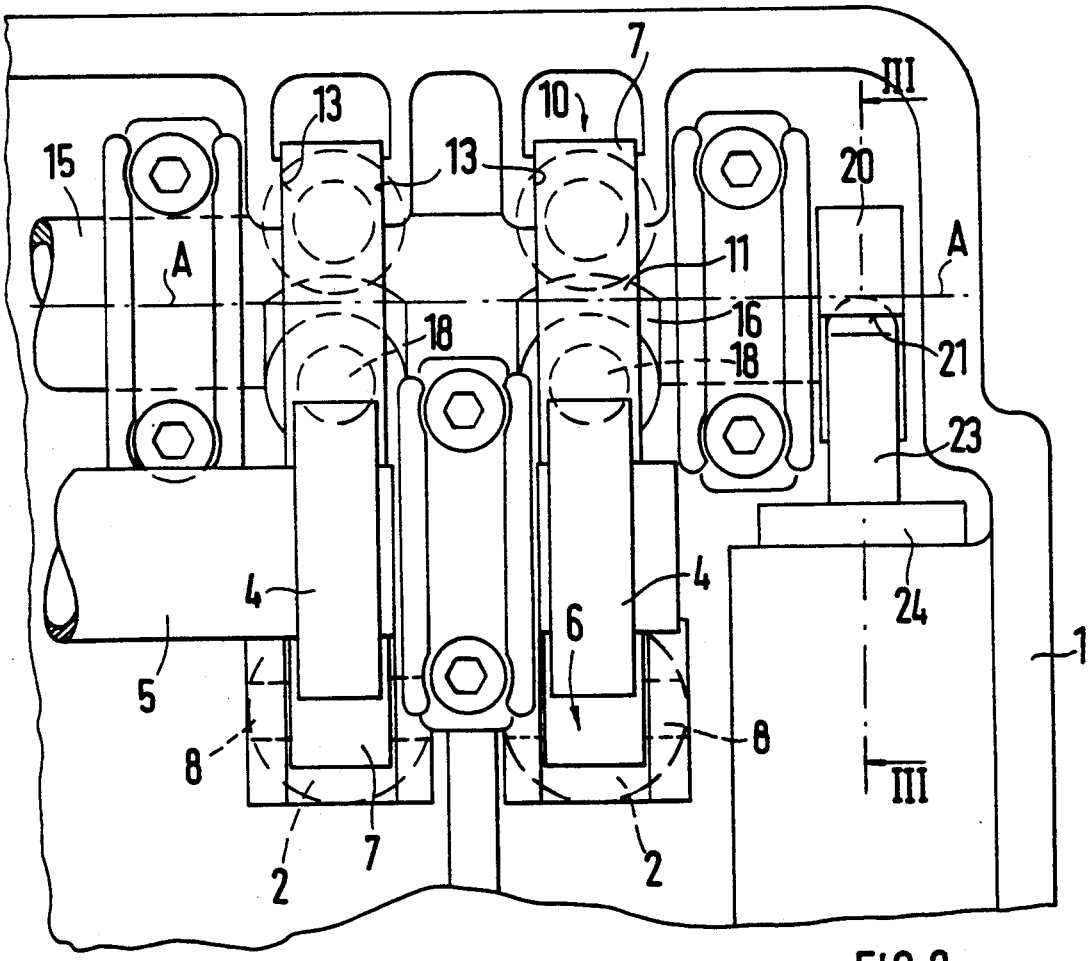
FIG. 2 is a top view in the direction of arrow Y according to FIG. 1.

A cylinder head 1 of an internal-combustion engine, which is not shown in detail, has a gas duct 3 which is controlled by a charge cycle valve 2. A camshaft 5 provided with cams 4 controls the charge cycle via a bearing arm 6 of a rocker lever 7. The bearing arm 6 is rotatably disposed on a shaft 8 situated in parallel to the camshaft 5 and arranged on the upper end of the charge cycle valve 2.

At a distance from the bearing arm 6, a roller 9 is rotatably disposed on the rocker lever 7 and is in continuous contact with one of the cams 4 so that this cam 4 is applied to the rocker lever 7 at a point P between the bearing arm 6 and the opposite free end 10. A line F-F, which intersects the point P and the shaft 8 in the center, is tangent to a circular-arc-shaped longitudinal part 12 constructed on an arm 11 of the free end 10. The free end 10 is disposed perpendicularly to the camshaft 5 and slides between mutually parallel contact surfaces 13 arranged in the cylinder head 1.

The radius R of curvature of the longitudinal part 12 intersects the longitudinal center axis A-A of a shaft which is rotatably disposed in the cylinder head 1 and is constructed as a control shaft 15. An abutment receiving device 16, which extends radially in the direction of the arm 11, is non-rotatably arranged on this control shaft 15. This abutment receiving device 16 has a cylindrical receiving device 17 in which abutments are held which are constructed as hydraulic valve clearance compensating elements 18. These are supplied with pressure oil through the hollow-drilled control shaft 15 and radial bores 19. By means of its longitudinal part 12, the rocker lever 7 rests on the compensating element 18 at an abutment point W.

A pivoted lever 20 is non-rotatably arranged on the control shaft 15 and has two recesses 21, 22 which are oppositely spaced with respect to the longitudinal axis A-A. Forcers 23 of a control element 26 equipped with oil-hydraulic pistons 24 and 25 engage in these recesses 21 and 22. The pistons 24, 25 are disposed in the cylinder head 1 and are alternately acted upon by a pressure oil feed 28 and controlled by a control valve 27 as a function of the internal-combustion engine parameters load L and rotational speed n.

The control valve 27 moves a control piston 30 which is provided with a groove 29 and which in each case connects the pressure oil feed 28 with a piston 24, 25 and, at the same time, connects the other piston 25, 24 with a return flow 31.

Figure 3:
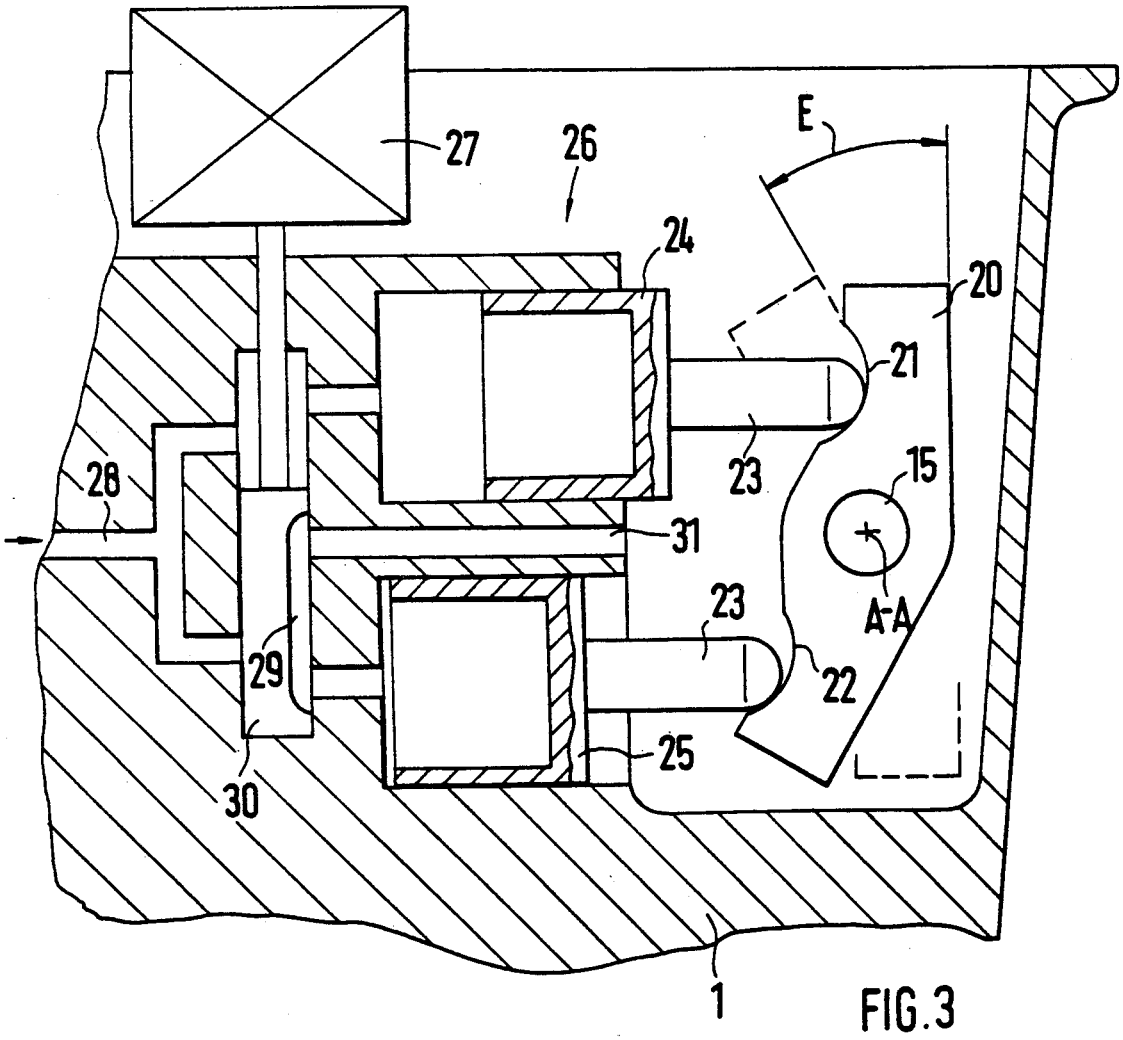
FIG. 3 is a sectional view along Line III—III according to FIG. 2.

In a first operating phase of the internal-combustion engine, the piston 25 is connected with the pressure oil feed 28, and the pivoted lever 20 is in the position according to FIG. 3 which is indicated by an interrupted line. The abutment receiving devices 16 are therefore in the position indicated by solid lines in FIG. 1. The abutment point W, forming a lever C, is situated relatively closely to point P so that, together with the lever B provided by the distance of Point P from the shaft 8, a relatively large valve lift will occur.

In a second operating phase of the internal-combustion engine, the control valve 27 pushes the control piston 30 into the position indicated in FIG. 3 so that the piston 24 is connected with the pressure oil feed 28 and pivots the pivoted lever 20 by an angle E into the position indicated by solid lines.

As a result, the abutment point W is shifted into the position indicated by the interrupted line in FIG. 1; the original lever C is lengthened to the lever D. Therefore, a relatively small valve lift occurs, together with the unchanged lever B.

If the control element 26 is constructed, for example, as a pneumatic pressure cell which operates continuously as a function of the intake pipe vacuum of the internal-combustion engine, the abutment point W can be shifted continuously in any position along the longitudinal part 12.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An internal-combustion engine comprising:

at least one charge cycle valve;

a rocker lever valve gear in a cylinder head and which is actuated by a camshaft, a rocker lever of the rocker lever valve gear having an end that controls the at least one charge cycle valve, the rocker lever having a changeable abutment point and an arc shaped longitudinal part;

a pivotable control shaft;

abutment receiving devices coupled to the control shaft so as to be pivotable together with the control shaft, wherein the longitudinal part of the rocker lever is in contact with the abutment receiving devices at the abutment point, the abutment point of the rocker lever being changed by pivoting of the control shaft;

a transmitting member coupled to the camshaft and which applies the camshaft to a first point of the rocker lever which is between a bearing arm applied to the charge cycle valve and the longitudinal part; and the bearing arm is rotatably disposed on a shaft disposed in parallel to the camshaft and arranged on an upper end of the charge cycle valve.

2. An internal-combustion engine according to claim 1, wherein a radius of curvature of the longitudinal part intersects a longitudinal center axis of the control shaft.

3. An internal-combustion engine according to claim 2, further comprising abutments in the abutment receiving devices and extending along the radius of curvature to the abutment point.

4. An internal-combustion engine according to claim 1, wherein the bearing arm is rotatably disposed on a shaft disposed in parallel to the camshaft and arranged on an upper end of the charge cycle valve.

5. An internal-combustion engine according to claim 1, wherein a line extending through the shaft and the first point is tangent to the longitudinal part.

6. An internal-combustion engine according to claim 1, further comprising a pivoted lever non-rotatably arranged on the control shaft to which a control element swivelling the control shaft is applied, the control element being controlled as a function of parameters of the internal-combustion engine.

7. An internal-combustion engine according to claim 6, wherein the control element includes pistons, said pistons being acted upon oil-hydraulically and applied to the pivoted lever above and below the control shaft.

8. An internal-combustion engine according to claim 1, wherein the end of the rocker lever which is adjacent to the longitudinal part, is guided perpendicularly to the camshaft while sliding between mutually parallel contact surfaces.

* * * * *